US012281524B2

(12) United States Patent
Lai et al.

(10) Patent No.: US 12,281,524 B2
(45) Date of Patent: Apr. 22, 2025

(54) CONTRACTION JOINT FOR INTELLIGENT COMPLETION AND DOWNHOLE COMPLETION SYSTEM

(71) Applicant: Schlumberger Technology Corporation, Sugar Land, TX (US)

(72) Inventors: Weichen Lai, Pearland, TX (US); Rashid Musayev, Rosharon, TX (US); Akhil Bahl, Richmond, TX (US); Daniel DeLeon, Alvin, TX (US); Leping Yu, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 22 days.

(21) Appl. No.: 18/553,470

(22) PCT Filed: Apr. 1, 2022

(86) PCT No.: PCT/US2022/022999
§ 371 (c)(1),
(2) Date: Sep. 29, 2023

(87) PCT Pub. No.: WO2022/212810
PCT Pub. Date: Oct. 6, 2022

(65) Prior Publication Data

US 2024/0183229 A1 Jun. 6, 2024

Related U.S. Application Data

(60) Provisional application No. 63/170,090, filed on Apr. 2, 2021.

(51) Int. Cl.
*E21B 17/07* (2006.01)

(52) U.S. Cl.
CPC ..... *E21B 17/07* (2013.01)

(58) Field of Classification Search
CPC ..... E21B 17/07; E21B 17/043
See application file for complete search history.

(56) References Cited

U.S. PATENT DOCUMENTS 1,844,257 A * 2/1932 Lincoln ..... E21B 17/07 464/18
2,886,289 A * 5/1959 Bus, Sr. ..... E21B 17/06 175/321

(Continued)

FOREIGN PATENT DOCUMENTS

AU 2014413985 B2 6/2016
WO 2009042310 A1 4/2009

(Continued)

OTHER PUBLICATIONS

International Search Report and Written Opinion issued in the PCT Application PCT/US2022/022999, dated Jul. 14, 2022 (9 pages).

(Continued)

*Primary Examiner* — David Carroll
(74) *Attorney, Agent, or Firm* — Jeffrey D. Frantz

(57) ABSTRACT

A contraction joint includes a mandrel at least partially disposed within an upper tubular member, the upper tubular member being capable of moving uphole and downhole to change a length of the contraction joint. The contraction joint also includes a nipple housing connected to the upper tubular member, a piston housing connected to the nipple housing, a support piston disposed in the piston housing, the support piston being affixed to an upper mandrel sub of the mandrel via at least one piston retaining device, a lock housing disposed between the upper tubular member and the upper mandrel sub, and a stroke locking mechanism disposed within the lock housing, the stroke locking mechanism including a profile that engages the nipple housing.

16 Claims, 3 Drawing Sheets

(56) References Cited

U.S. PATENT DOCUMENTS

| | | | | |
|---|---|---|---|---|
| 3,356,145 | A * | 12/1967 | Fredd | E21B 34/10 166/322 |
| 5,103,902 | A | 4/1992 | Ross | |
| 6,367,552 | B1 * | 4/2002 | Scott | E21B 17/07 166/242.7 |
| 6,540,025 | B2 | 4/2003 | Scott | |
| 7,503,395 | B2 | 3/2009 | Meijer et al. | |
| 7,806,190 | B2 | 10/2010 | Du | |
| 8,061,430 | B2 | 11/2011 | Du | |
| 9,371,703 | B2 | 6/2016 | Roane | |
| 10,301,888 | B2 | 5/2019 | Richards | |
| 10,422,191 | B2 | 9/2019 | Richards | |
| 2010/0224360 | A1 * | 9/2010 | MacDougall | E21B 44/00 166/250.01 |
| 2010/0224375 | A1 | 9/2010 | Du | |
| 2013/0199799 | A1 | 8/2013 | Phan | |
| 2016/0069145 | A1 | 3/2016 | McGuire | |
| 2016/0153248 | A1 * | 6/2016 | Richards | E21B 17/06 166/335 |
| 2016/0290062 | A1 | 10/2016 | Richards | |
| 2017/0183918 | A1 | 6/2017 | Grattan | |
| 2017/0183919 | A1 | 6/2017 | Cochran | |

FOREIGN PATENT DOCUMENTS

| | | | |
|---|---|---|---|
| WO | 2010078111 | A2 | 7/2010 |
| WO | 2019067307 | A1 | 4/2019 |
| WO | 2022271463 | A1 | 12/2022 |

OTHER PUBLICATIONS

International Search Report and Written Opinion issued in the PCT Application PCT/US2022/033005, dated Sep. 22, 2022 (9 pages).

* cited by examiner

CONTRACTION JOINT FOR INTELLIGENT COMPLETION AND DOWNHOLE COMPLETION SYSTEM

CROSS-REFERENCE TO RELATED APPLICATIONS

The present application is a National Stage Entry of International Application No. PCT/US2022/022999, filed Apr. 1, 2022, which claims priority benefit of U.S. Provisional Application No. 63/170,090, filed Apr. 2, 2021, the entirety of which is incorporated by reference herein and should be considered part of this specification.

BACKGROUND

In many well related operations, contraction joints are used with well completions, such as between two or more completion assemblies, to compensate for contraction and expansion of the completion string. Wellbore completions typically utilize one or more control lines to carry signals between components within the wellbore and/or the surface. It can be difficult to control or maintain the integrity of those control lines at a contraction joint because axial movement of the contraction joint can cause the lines to knot or tangle as the contraction joint expands or contracts. Moreover, it may be difficult to control the functionality of the contraction joint until the contraction joint reaches a desired depth downhole and to accommodate production operations at depth through the contraction joint. There is a need, therefore, for a contraction joint that can accommodate control lines, and that remains locked until a desired depth downhole is reached to facilitate production operations.

SUMMARY

According to one or more embodiments of the present disclosure, a contraction joint includes an upper tubular member having a bore therethrough; a mandrel including: an upper mandrel sub including a port; a lower mandrel; and a mandrel crossover connecting the upper mandrel sub to the lower mandrel, wherein the mandrel is at least partially disposed within the upper tubular member, wherein the upper tubular member is capable of moving uphole and downhole to change a length of the contraction joint; a nipple housing connected to the upper tubular member; a piston housing connected to the nipple housing and the lower mandrel; a support piston disposed in the piston housing, the support piston being affixed to the upper mandrel sub of the mandrel via at least one piston retaining device, a lock housing disposed between the upper tubular member and the upper mandrel sub of the mandrel; and a stroke locking mechanism disposed within the lock housing, the stroke locking mechanism including a profile that engages the nipple housing, wherein, in a locked position, the stroke locking mechanism is supported by the support piston, and the profile of the stroke locking mechanism prevents the nipple housing from moving.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

The present disclosure generally relates to a system and methodology that facilitates the use of a contraction joint in a well completion application. Specifically, the present disclosure relates to a contraction joint that includes a stroke locking mechanism that allows the contraction joint to remain locked when running in hole, and allows the contraction joint to achieve contraction functionality at depth downhole. Advantageously, the contraction joint according to one or more embodiments of the present disclosure accommodates one or more control lines and facilitates production operations at depth when in the unlocked position.

Figure 1:
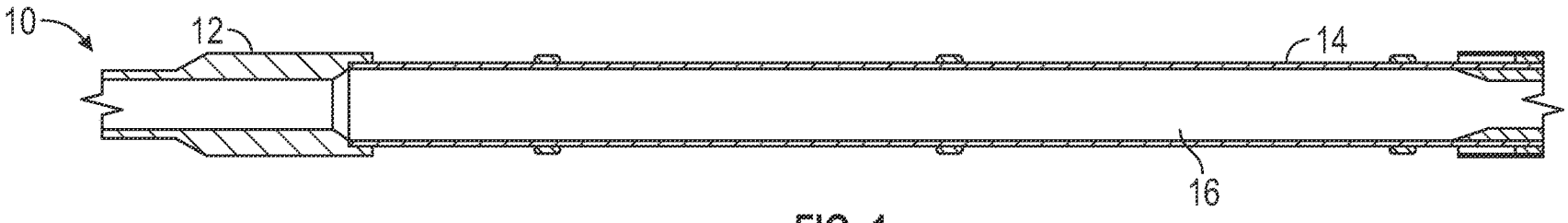
FIG. 1 shows a top section of a contraction joint according to one or more embodiments of the present disclosure.
Figure 2:
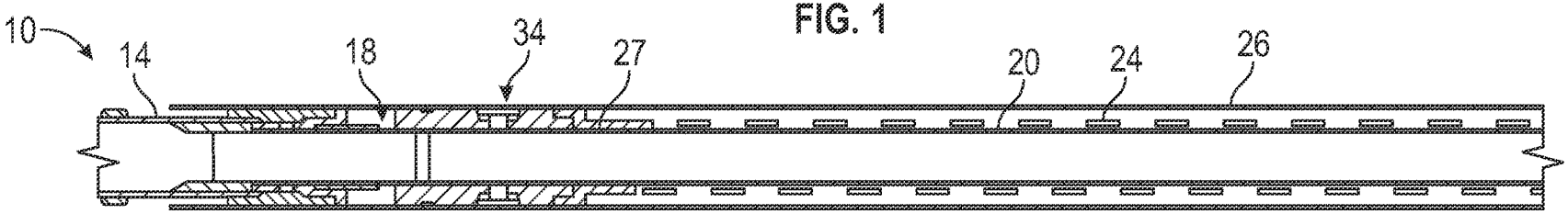
FIG. 2 shows a middle section of a contraction joint according to one or more embodiments of the present disclosure.
Figure 3:
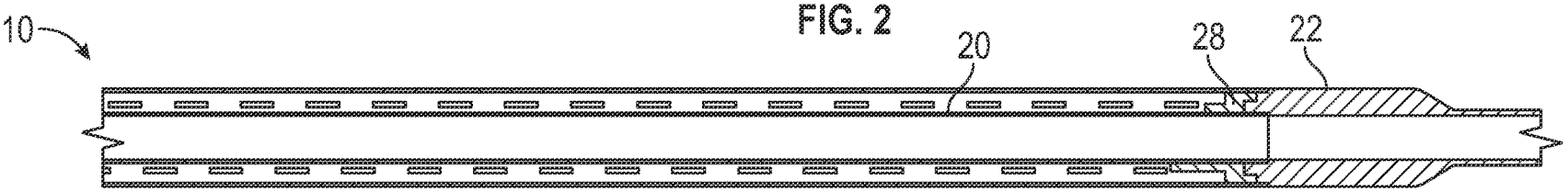
FIG. 3 shows a bottom section of a contraction joint according to one or more embodiments of the present disclosure.

Referring now to FIGS. 1-3, a contraction joint 10 according to one or more embodiments of the present disclosure is shown. Specifically, FIG. 1 shows a top section of the contraction joint 10, FIG. 2 shows a middle section of the contraction joint 10, and FIG. 3 shows a bottom section of the contraction joint 10. In one or more embodiments of the present disclosure, the contraction joint 10 may be a component of a well completion system having an upper completion and a lower completion (not shown), for example. As shown in FIG. 1, the top section of the contraction joint 10 may include a top sub 12 connected to an upper tubular member 14, according to one or more embodiments of the present disclosure. As also shown in FIG. 1, the upper tubular member 14 has a bore 16 therethrough, according to one or more embodiments of the present disclosure. As shown in FIG. 2, the middle section of the contraction joint 10 may include a mandrel 18 at least partially disposed within the upper tubular member 14 in a telescoping configuration. Due to this configuration, the upper tubular member 14 is capable of moving uphole and downhole with respect to the mandrel 18 to change a length of the contraction joint 10, according to one or more embodiments of the present disclosure. Moreover, the contraction joint 10 may include an anti-rotation mechanism, for example, to prevent rotation of the upper tubular member 14 and the mandrel 18 relative to one another, while allowing telescoping movement of the upper tubular member 14 and the mandrel 18 relative to one another. As further described below, the mandrel 18 of the contraction joint 10 may include, inter alia, a lower mandrel 20 according to one or more embodiments of the present disclosure. As shown in FIG. 3, the bottom section of the contraction joint 10 may include a bottom sub 22 connected to the lower mandrel 20. According to one or more embodiments of the present disclosure, the upper completion of the well completion system may be connected to the contraction joint 10 via the top sub 12, and the lower completion of the well completion system may be connected to the contraction joint 10 via the bottom sub 22.

Figure 4:
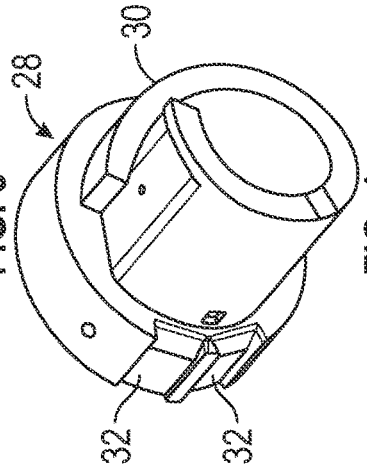
FIG. 4 shows a transition component of the middle and bottom sections of the contraction joint, according to one or more embodiments of the present disclosure.

In view of FIGS. 2 and 3, the contraction joint 10 according to one or more embodiments of the present disclosure may accommodate at least one cable 24 coiled around at least a portion of the lower mandrel 20. According to one or more embodiments of the present disclosure, the at least one cable 24 may be a control line, such as an optical, electrical, and/or hydraulic control line to carry signals between components within the wellbore and/or the surface. According to one or more embodiments of the present disclosure, the top section of the contraction joint 10, as shown in FIG. 1, may include a plurality of bypass rings to facilitate intelligent completion cable bypass, for example. Referring back to FIGS. 2 and 3, the contraction joint 10 according to one or more embodiments of the present disclosure may include a cable shroud 26 disposed around the lower mandrel 20 to protect the at least one cable 24. As shown in FIGS. 2 and 3, the contraction joint 10 may also include at least one transition component 28 affixed to the lower mandrel 10. FIG. 4 shows the transition component 28 of the contraction joint 10 according to one or more embodiments of the present disclosure in greater detail. As shown in FIG. 4, the transition component 28 includes a coil guide 30 and at least one straight slot 32 in one or more embodiments of the present disclosure. With this configuration, the transition component 28 allows the at least one cable 24 to transition from a coiled configuration to a straight configuration for running uphole.

Figure 5:
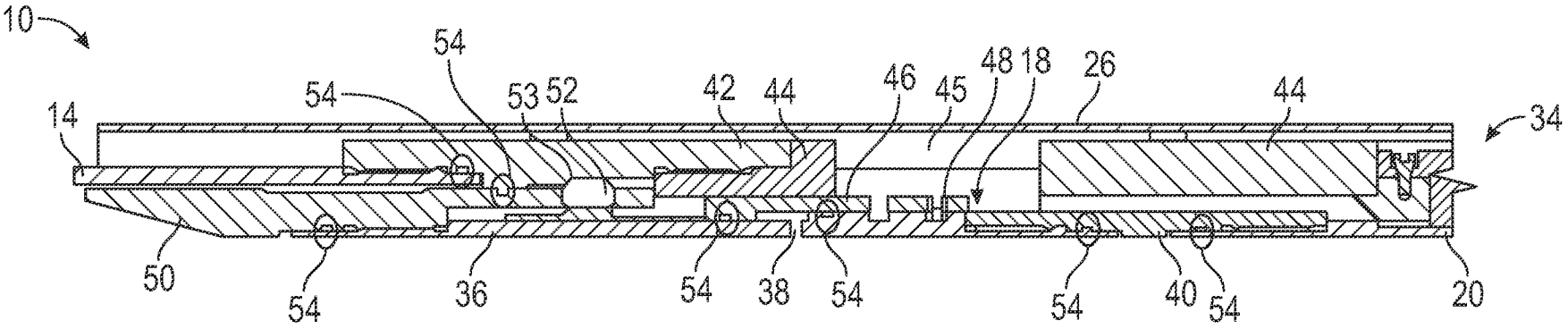
FIG. 5 shows a detailed cross-sectional view of a portion of the middle section of the contraction joint with a stroke locking mechanism in a locked position, according to one or more embodiments of the present disclosure.

Referring now to FIG. 5, a detailed cross-sectional view of a portion of the middle section of the contraction joint 10 is shown. Specifically, FIG. 5 provides a more detailed view of the mandrel 18 shown in FIG. 2, for example. According to one or more embodiments of the present disclosure, the mandrel 18 of the contraction joint 10 includes an upper mandrel sub 36 including a port 38, the lower mandrel 20, and a mandrel crossover 40 connecting the upper mandrel sub 36 to the lower mandrel 20. According to one or more embodiments of the present disclosure, the contraction joint 10 also includes a nipple housing 42 connected to the upper tubular member 14. According to one or more embodiments of the present disclosure, the contraction joint 10 also includes a piston housing 44 connected to the nipple housing 42 and the lower mandrel 20. In one or more embodiments of the present disclosure, the piston housing 44 may include a window 45, as shown in FIG. 5, for example. According to one or more embodiments of the present disclosure, the contraction joint 10 also includes a support piston 46 disposed in the piston housing 44. In one or more embodiments of the present disclosure, the support piston 46 is affixed to the upper mandrel sub 36 of the mandrel 18 via at least one piston retaining device 48. In one or more embodiments of the present disclosure, the window 45 in the piston housing 44 may provide easier access to the at least one piston retaining device 48 during assembly of the contraction joint 10, for example. According to one or more embodiments of the present disclosure, the at least one piston retaining device 48 may be a shear screw, a collet, or a lock ring, for example.

Still referring to FIG. 5, the contraction joint 10 according to one or more embodiments of the present disclosure may also include a lock housing 50 disposed between the upper tubular member 14 and the upper mandrel sub 36 of the mandrel 18. The contraction joint 10 also includes a stroke locking mechanism 52 disposed in the lock housing 50, according to one or more embodiments of the present disclosure. The stroke locking mechanism 52 includes a profile 53 that engages the nipple housing 42 in one or more embodiments of the present disclosure. FIG. 5 shows the stroke locking mechanism 52 in the locked position, which is the position that the stroke locking mechanism 52 assumes when the contraction joint 10 is run-in-hole, for example. Specifically, FIG. 5 shows that the stroke locking mechanism 52 is supported by the support piston 46, and the profile 53 of the stroke locking mechanism 52 prevents the nipple housing 42 from moving.

Still referring to FIG. 5, a more detailed partial view of the anti-rotation mechanism 34 is shown. As shown, the anti-rotation mechanism 34 may be affixed to the piston housing 44 with a fastener, for example, according to one or more embodiments of the present disclosure.

Still referring to FIG. 5, the contraction joint 10 according to one or more embodiments of the present disclosure includes at least one seal 54 disposed between the support piston 46 and the upper mandrel sub 36 on either side of the port 38. As shown in FIG. 5, in one or more embodiments of the present disclosure, the contraction joint 10 may include seals 54 in other locations such as between the lock housing 50 and the upper mandrel sub 36, between the upper tubular member 14 and the nipple housing 42, between the nipple housing 42 and the lock housing 50, between the mandrel crossover 50 and the upper mandrel sub 36, and between the mandrel crossover 50 and the lower mandrel 10, for example. According to one or more embodiments of the present disclosure, the seals 54 may be O-ring seals, for example.

Figure 6:
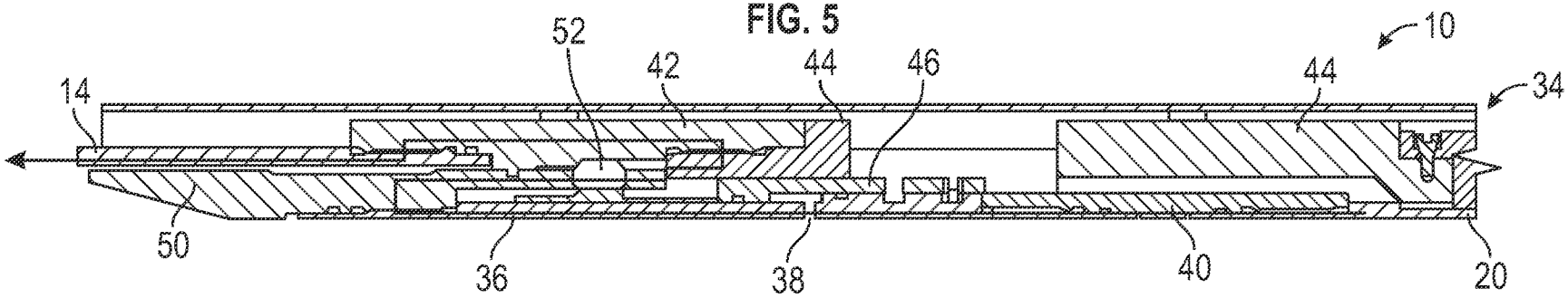
FIG. 6 shows a detailed cross-sectional view of a portion of the middle section of the contraction joint with the stroke locking mechanism in the locked position with tension applied, according to one or more embodiments of the present disclosure.

Referring now to FIG. 6, the stroke locking mechanism 52 of the contraction joint 10 is shown in the locked position with tension applied through the upper tubular member 14. The source of this tension may be from one or more components of the lower completion downhole of the contraction joint 10, for example. As shown in FIG. 6, when tension is applied through the upper tubular member 14, the tension transfers to the nipple housing 42, to the piston housing 44, to the lock housing 50, to the upper mandrel sub 36, to the mandrel crossover 40, to the lower mandrel 20, and to the lower completion, according to one or more embodiments of the present disclosure.

Figure 7:
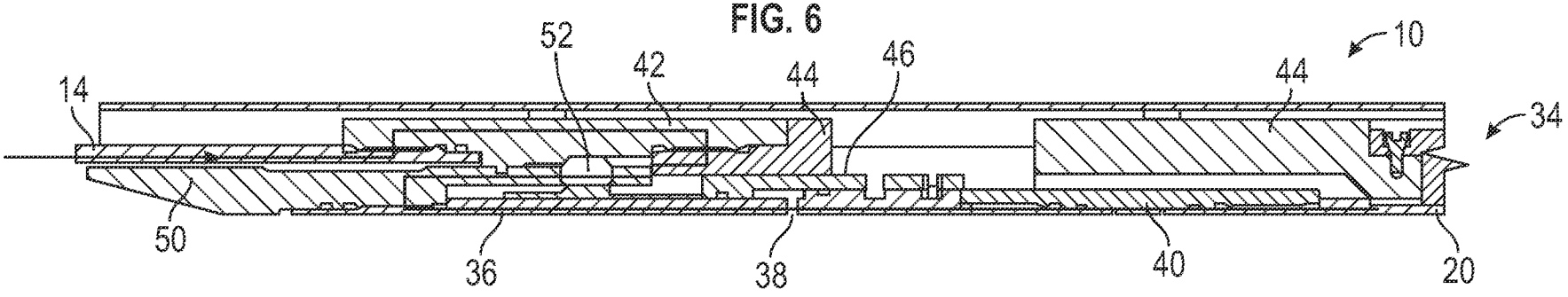
FIG. 7 shows a detailed cross-sectional view of a portion of the middle section of the contraction joint with the stroke locking mechanism in the locked position with compression applied, according to one or more embodiments of the present disclosure.

Referring now to FIG. 7, the stroke locking mechanism 52 of the contraction joint 10 is shown in the locked position with compression applied through the upper tubular member 14. The source of this compression may be from one or more components of the lower completion downhole of the contraction joint 10, for example. As shown in FIG. 7, when compression is applied through the upper tubular member 14, the compression transfers to the nipple housing 42, to the stroke locking mechanism 52, to the lock housing 50, to the upper mandrel sub 36, to the mandrel crossover 40, to the lower mandrel 20, and to the lower completion, according to one or more embodiments of the present disclosure.

Figure 8:
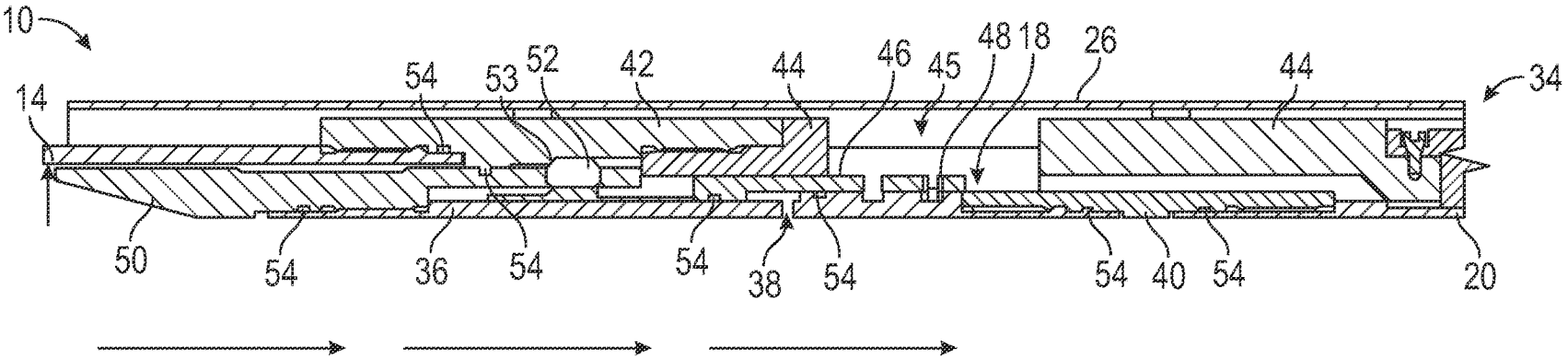
FIG. 8 shows a detailed cross-sectional view of a portion of the middle section of the contraction joint having a hydraulic tubing pressure path flowing therethrough, according to one or more embodiments of the present disclosure.
Figure 9:
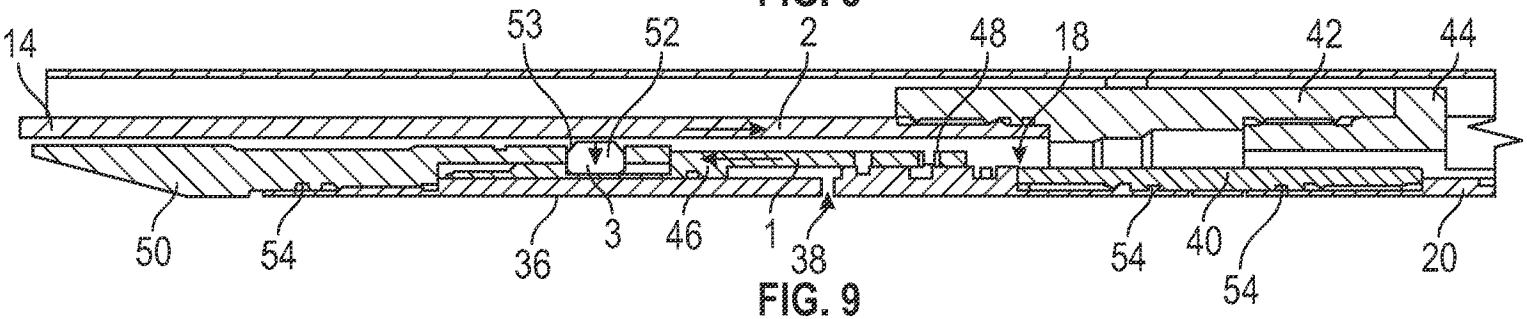
FIG. 9 shows a detailed cross-sectional view of a portion of the middle section of the contraction joint with the stroke locking mechanism in an unlocking position, according to one or more embodiments of the present disclosure.

In operation, a well completion including the contraction joint 10 according to one or more embodiments of the present disclosure may be run-in-hole to a downhole location while the stroke locking mechanism 52 of the contraction joint 10 is in the locked position. In view of FIG. 1, hydraulic tubing pressure may be applied into the bore 16 of the upper tubular member 14. In one or more embodiments of the present disclosure, this hydraulic fluid may come from a surface location, for example. Referring now to FIG. 8, a detailed cross-sectional view of a portion of the middle section of the contraction joint 10 is shown. Specifically, FIG. 8 shows the stroke locking mechanism 52 of the contraction joint 10 still in the locked position as the applied hydraulic tubing pressure flows into the port 38 of the upper mandrel sub 36 from the tubing. Because of the seals 54 disposed between the support piston 46 and the upper mandrel 36 on either side of the port 38, a pressure differential is created as the hydraulic tubing pressure flows into the port 38 until the at least one piston retaining device 48 breaks, as shown in FIG. 9. Other seals 54 in the contraction joint 10, such as at interfaces of the nipple housing 42, for example, may block flow of hydraulic tubing pressure through the contraction joint 10 to facilitate building of the pressure differential at the port 38 of the upper mandrel sub 36.

Figure 10:
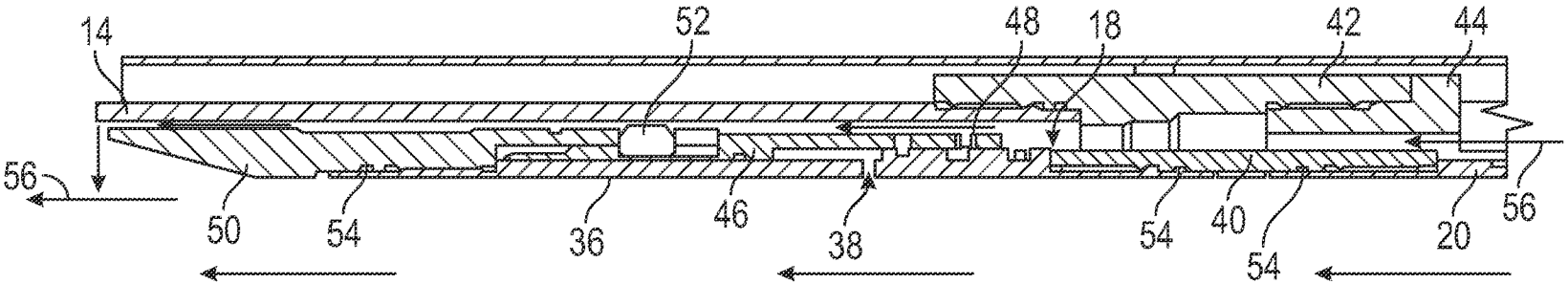
FIG. 10 shows a detailed cross-sectional view of a portion of the middle section of the contraction joint with fluid flow paths identified when the stroke locking mechanism is in the unlocked position, according to one or more embodiments of the present disclosure.

Referring back to FIG. 9, after the at least one piston retaining device 48 breaks, the support piston 46 shifts uphole, causing the profile 53 of the stroke locking mechanism 52 to disengage from the nipple housing 42, according to one or more embodiments of the present disclosure. The compression force applied through the upper tubular member 14 of the contraction joint 10, as previously described, pushes the stroke locking mechanism 52 inward to an unlocked position, according to one or more embodiments of the present disclosure. Once the stroke locking mechanism 52 is in the unlocked position, the upper tubular member 14, the nipple housing 42, and the piston housing 44 are pushed downhole, thereby creating an annulus flow path 56 between an outer diameter of the mandrel 18 and an inner diameter of the upper tubular member 14, as shown in FIG. 10, for example. Still referring to FIG. 10, a production operation may be initiated after the upper tubular member 14, the nipple housing 42, and the piston housing 44 of the contraction joint 10 are pushed downhole. According to one or more embodiments of the present disclosure, during the production operation, production fluid flows uphole along the annulus flow path 56 and through the mandrel 18 and into the bore 16 of the upper tubular member 14 to a surface location.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A contraction joint, comprising:

an upper tubular member having a bore therethrough;

a mandrel comprising: an upper mandrel sub comprising a port; a lower mandrel; and a mandrel crossover connecting the upper mandrel sub to the lower mandrel, wherein the mandrel is at least partially disposed within the upper tubular member, wherein the upper tubular member is capable of moving uphole and downhole to change a length of the contraction joint;

a nipple housing connected to the upper tubular member;

a piston housing connected to the nipple housing and the lower mandrel;

a support piston disposed in the piston housing, the support piston being affixed to the upper mandrel sub of the mandrel via at least one piston retaining device, a lock housing disposed between the upper tubular member and the upper mandrel sub of the mandrel; and a stroke locking mechanism disposed within the lock housing, the stroke locking mechanism comprising a profile that engages the nipple housing, wherein, in a locked position, the stroke locking mechanism is supported by the support piston, and the profile of the stroke locking mechanism prevents the nipple housing from moving.

2. The contraction joint of claim 1, wherein application of hydraulic tubing pressure through the port of the upper mandrel sub creates a pressure differential that breaks the at least one piston retaining device and shifts the support piston uphole, causing the profile of the stroke locking mechanism to disengage from the nipple housing, wherein application of a compression force pushes the stroke locking mechanism inward to an unlocked position, and wherein the upper tubular member, the nipple housing, and the piston housing are able to move downhole, thereby creating an annulus flow path between the mandrel and the upper tubular member, when the stroke locking mechanism is in the unlocked position.

3. The contraction joint of claim 1, further comprising an anti-rotation mechanism affixed to the piston housing.

4. The contraction joint of claim 1, further comprising at least one seal disposed between the support piston and the upper mandrel sub on either side of the port.

5. The contraction joint of claim 1, further comprising at least one cable coiled around at least a portion of the lower mandrel.

6. The contraction joint of claim 5, further comprising a cable shroud disposed around the lower mandrel to protect the at least one cable.

7. The contraction joint of claim 5, further comprising at least one transition component affixed to the lower mandrel, the at least one transition component allowing the at least one cable to transition from a coiled configuration to a straight configuration for running uphole.

8. A system, comprising:

an upper completion;

a lower completion; and the contraction joint of claim 1, wherein the contraction joint further comprises: a top sub connected to the upper tubular member; and a bottom sub connected to the lower mandrel, wherein the upper completion is connected to the top sub, and wherein the lower completion is connected to the bottom sub.

9. A method, comprising:

running a well completion comprising the contraction joint of claim 1 to a downhole location, wherein the stroke locking mechanism of the contraction joint is in the locked position during the running step;

applying hydraulic tubing pressure into the bore of the upper tubular member, wherein the hydraulic tubing pressure enters the port of the upper mandrel sub from the bore of the upper tubular member, thereby creating a pressure differential;

breaking the at least one piston retaining device using the pressure differential;

shifting the support piston uphole, causing the profile of the stroke locking mechanism to disengage from the nipple housing, pushing the stroke locking mechanism inward to an unlocked position; and moving the upper tubular member, the nipple housing, and the piston housing downhole, thereby creating an annulus flow path between an outer diameter of the mandrel and an inner diameter of the upper tubular member.

10. The method of claim 9, further comprising:

initiating a production operation after the moving step, wherein, during the production operation, production fluid flows uphole along the annulus flow path, and through the mandrel and into the bore of the upper tubular member to a surface location.

11. The method of claim 9, the contraction joint further comprising an anti-rotation mechanism.

12. The method of claim 9, the contraction joint further comprising at least one seal disposed between the support piston and the upper mandrel sub on either side of the port.

13. The method of claim 9, the contraction joint further comprising at least one cable coiled around at least a portion of the lower mandrel.

14. The method of claim 13, the contraction joint further comprising a cable shroud disposed around the lower mandrel to protect the at least one cable.

15. The method of claim 13, further comprising at least one transition component affixed to the lower mandrel, the at least one transition component allowing the at least one cable to transition from a coiled configuration to a straight configuration for running uphole.

16. The method of claim 9, wherein the well completion further comprises: an upper completion; and a lower completion, wherein the contraction joint further comprises: a top sub connected to the upper tubular member; and a bottom sub connected to the lower mandrel, wherein the upper completion is connected to the top sub, and wherein the lower completion is connected to the bottom sub.

* * * * *